United States Patent [19]

Shibata

[11] 4,055,006

[45] Oct. 25, 1977

[54] DEEP-SEA ORE COLLECTING AND HOISTING APPARATUS

[75] Inventor: Jitsu Shibata, Tokyo, Japan

[73] Assignee: Mitsubishi Kaihatsu Kabushiki Kaisha, Japan

[21] Appl. No.: 673,591

[22] Filed: Apr. 5, 1976

Related U.S. Application Data

[63] Continuation of Ser. No. 506,876, Sept. 17, 1974, abandoned.

[30] Foreign Application Priority Data

Sept. 21, 1973 Japan ..... 48-106590
Oct. 3, 1973 Japan ..... 48-111111

[51] Int. Cl.[2] ..... E02F 3/08
[52] U.S. Cl. ..... 37/69; 37/DIG. 8
[58] Field of Search ..... 37/69, 55, 58, 60, 195, 37/DIG. 8, 71; 299/8, 9

[56] References Cited

U.S. PATENT DOCUMENTS

| | | | |
|---|---|---|---|
| 528,433 | 10/1894 | Hyatt | 37/69 |
| 1,070,271 | 8/1913 | Lybeck | 37/55 |
| 1,584,277 | 5/1926 | Dec | 299/8 |
| 2,288,701 | 7/1942 | Heden | 37/55 |
| 2,363,251 | 11/1944 | Jurisich | 37/55 |
| 3,226,854 | 1/1966 | Mero | 37/55 X |
| 3,672,079 | 6/1972 | Masuda et al. | 37/69 |
| 3,943,644 | 3/1976 | Walz | 37/69 |

FOREIGN PATENT DOCUMENTS

| | | | |
|---|---|---|---|
| 1,239,178 | 7/1971 | United Kingdom | 37/69 |

*Primary Examiner*—Clifford D. Crowder
*Attorney, Agent, or Firm*—Robert E. Burns; Emmanuel J. Lobato; Bruce L. Adams

[57] ABSTRACT

An apparatus for hoisting ores from the deep-sea comprises a flexible endless member such as ropes or chains hanging from a buoyant ore-collecting vessel down to the bottom of the sea, a number of baggy nets fitted along the flexible endless member, a driving mechanism provided on the buoyant ore-collecting vessel for advancing the flexible endless member, and an ore collecting and filling mechanism for filling the collected ore into the baggy nets, which is towed on the sea bottom by a winch connected to a power and towing vessel floating ahead of the buoyant ore-collecting vessel. As a consequence of the advancing of the flexible endless member by the driving mechanism and the movement of the buoyant ore-collecting vessel, the baggy nets are successively lowered down to the sea bottom and hoisted therefrom with the ore filled by the ore collecting and filling mechanism.

1 Claim, 3 Drawing Figures

DEEP-SEA ORE COLLECTING AND HOISTING APPARATUS

This is a continuation, of application Ser. No. 506,876, filed Sept. 17, 1974, now abandoned.

DETAILED DESCRIPTION OF THE INVENTION

The present invention relates to apparatus for collecting and hoisting up to the surface of the sea granular or massive ores deposited or scattered at the bottom of the deep sea.

A conventional apparatus of this type comprises an endless rope fitted with a number of buckets, which is to be sunk from a ship to the bottom of the deep sea. By circulatingly moving the rope along the bottom, ores scattered thereat are collected by each bucket. Because many buckets are dragged along the sea bottom of extensive area, it is practically impossible to monitor its working condition. In addition, this method is unsuited for collecting a large quantity of ores, because there is a limit to the tensile force and winching speed of the rope that drags the buckets filled with the collected ores along the sea bottom.

Another conventional apparatus of this type combines an ore scraping device, which is dragged along the sea bottom, with a sea-water pump, so as to collect and transport ores at the sea bottom in a slurry state. With an increase in the length of its slurry transport pipe, which is necessitated by increasing water depth, resistance loss inside the pipe becomes greater. On the other hand, there will also arise the need of providing many relay pump stations in the transport pipe system, the lift of the pump being limited. All this leads to complicating the structure of the system.

The aforesaid ore scriping device is towed by a ship running over the sea. Therefore, it sometimes becomes difficult to insure its dead-slow steady advancing, depending on the conditions above and below the sea surface. On such occasions, there is a possibility of its separating from the sea bottom.

An object of this invention is to solve the above-described problems, through the provision of apparatus for efficiently collecting and hoisting ores scattered at the bottom of the deep sea.

To achieve this end, deep-sea ore collecting and hoisting apparatus according to this invention comprises endless flexible lines sunk from a ship, floating over the sea, to the bottom of the deep sea, a number of baggy nets fitted along said lines at approximately regular intervals, a line driving mechanism provided in said ship for circulating said lines, and an ore collecting and filling mechanism adapted to collect and put baggy nets at the bottom of the deep sea into said ore that are sunk and hoisted one by one as said lines are driven ahead, like an endless track, by the action of said line driving mechanism and the advance of said ship.

Different from the conventional continuous buckets system whose buckets are dragged along the sea bottom for a long distance, the buckets fitted to the flexible lines of this invention, such as endless ropes or chains, are placed on the sea bottom and hoisted therefrom one by one, as said flexible lines moves ahead like an endless track. This offers a great advantage in respect of strength. Besides, filling of ores into each baggy net is conducted by the use of a specialty ore collecting and filling mechanism, which permits the entire system to perform efficient ore collection and hoisting.

The deep-sea ore collecting and hoisting apparatus according to this invention is characterized also by the fact that its aforesaid ore collecting and filling mechanism comprises a winch sunk to the bottom of the deep sea, a plough member dragged by said winch, and an ore transport member for transporting ores collected by said plough member to the baggy nets placed on said sea bottom.

This combination of the winch and the plough member dragged thereby permits collecting ores at the sea bottom in keeping with the advance of said endless lines therealong, as an endless track. The ores thus collected are transported, in succession, into the baggy nets by the ore transport member. Consequently, collection and hoisting of ores from the deep sea bottom can be accomplished very efficiently.

Another feature of the apparatus of this invention lies in the fact that said ore collecting and filling mechanism of a plough member dragged along the sea bottom and a pump that transports the ores collected by said plough member into said baggy net arrived at the sea bottom, through a duct fitted with an earth and sand discharging net.

By the use of the above-described apparatus, ores are continuously sent, by said pump and through said duct provided with an earth and sand discharging nets, into a space of the baggy net that has reached the deep sea bottom, while being collected by said plough member dragged therealong. This also offers an advantage of very efficient collection and hoisting of ores from the deep sea bottom.

Now an embodiment of this invention will be described with reference to the accompanying drawings, in which.

Figure 1:
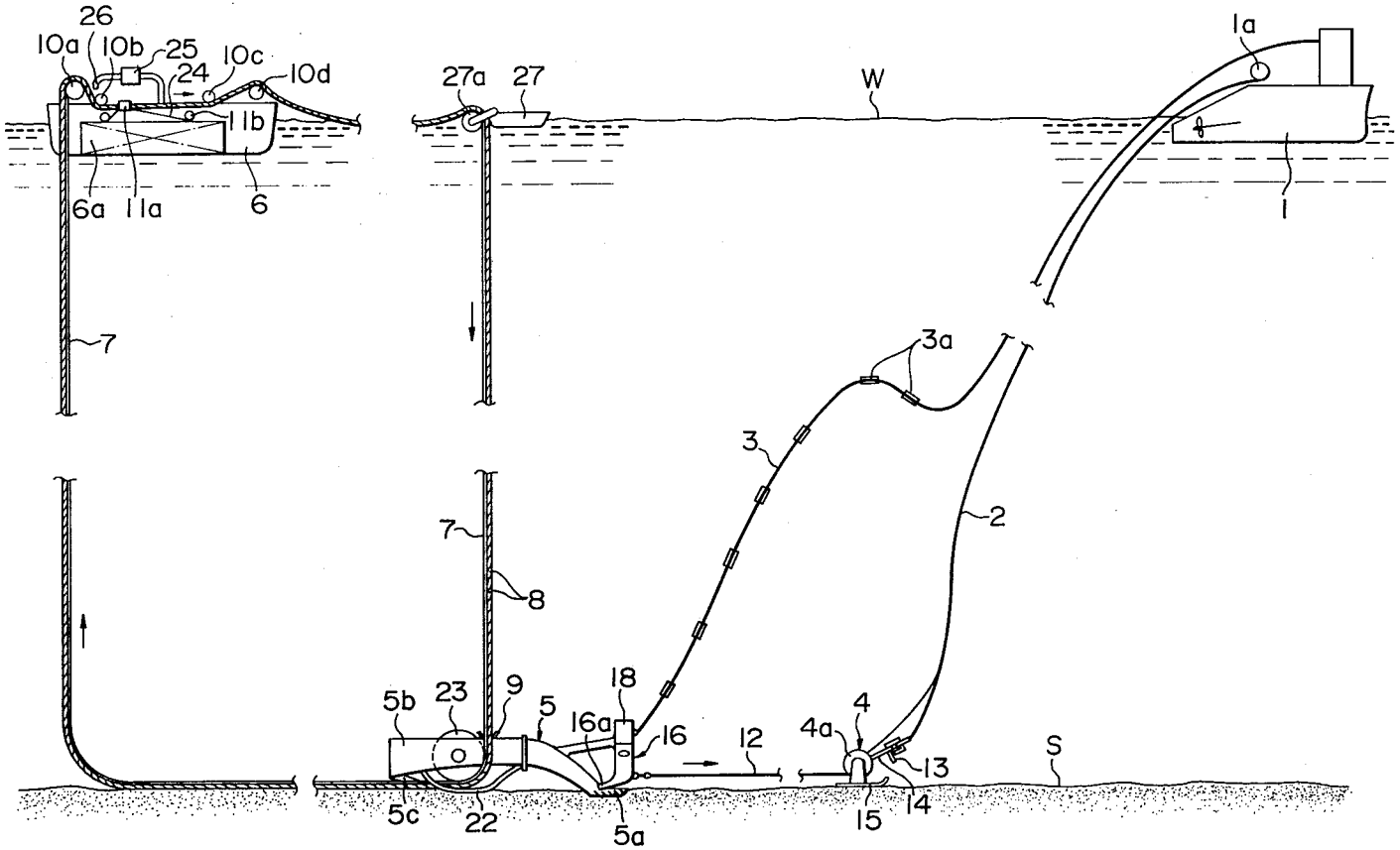
FIG. 1 is a side elevation of deep-sea ore collecting and hoisting apparatus, which is an embodiment of this invention.

In FIG. 1, a winch 4 and an ore collecting and filling mechanism 5 loaded on a power and towing vessel 1 floating on the surface of the sea W are cast from the stern thereof down to the sea bottom S.

The power and towing vessel 1 is connected with the winch 4 through a winch holding rope 2 combined with a winch power line, and also with the ore collecting and filling mechanism 5 through a power line 3.

To the lower end portion of the power line 3 are fitted floats 3*a*, so that said power line 3 does not get tangled with the winch holding rope 2 and a tension working on the upper end of the power line 3 is decreased.

From a buoyany ore collecting vessel 6 floating on the sea surface W, there are sunk to the sea bottom S two endless, flexible lines 7, such as ropes or chains, to which a number of baggy nets 8, are continuously, and at regular intervals, fitted.

The lines 7 are so arranged as to pass through the inside of a line guide 9 provided in the ore collecting and filling mechanism 5. This arrangement is done by previously bringing the power and towing vessel 1 and the buoyant ore-collecting vessel 6 close to each other, before casting the ore collecting and filling mechanism 5 and the lines 7 down to the sea bottom S.

Also, the buoyant ore-collecting vessel is provided with a line driving mechanism which comprises rollers 10*a*, 10*b*, 10*c* and 10*d* for guiding the lines 7, a line holding member 11*a* for driving said lines 7, and a line driving winch 11*b*.

When the lines 7 are ropes, they are made of synthetic resin. On the other hand, when they are chains, special ones made by filling hollow steel links with hard foamed resin to reduce the specific gravity of the whole chain are used.

The winch 4 has a drum 4*a* rotatingly driven by a winch motor, the function of said drum 4*a* being to take up a wire 12 for trailing the ore collecting and filling mechanism 5.

Furthermore, the winch 4 is pivotally fitted with a metal arm 14 having a projection 13 for holding said winch 4 fast to the sea bottom S, with the winch holding rope 2 being attached to this metal arm 14.

On slackening out the winch holding rope 2, the metal arm 14 rotates downward and the projection 13 sticks into the sea bottom S, thereby holding the winch 4 fast thereto.

A sleigh 15 is fitted under the winch 4.

Figure 2:
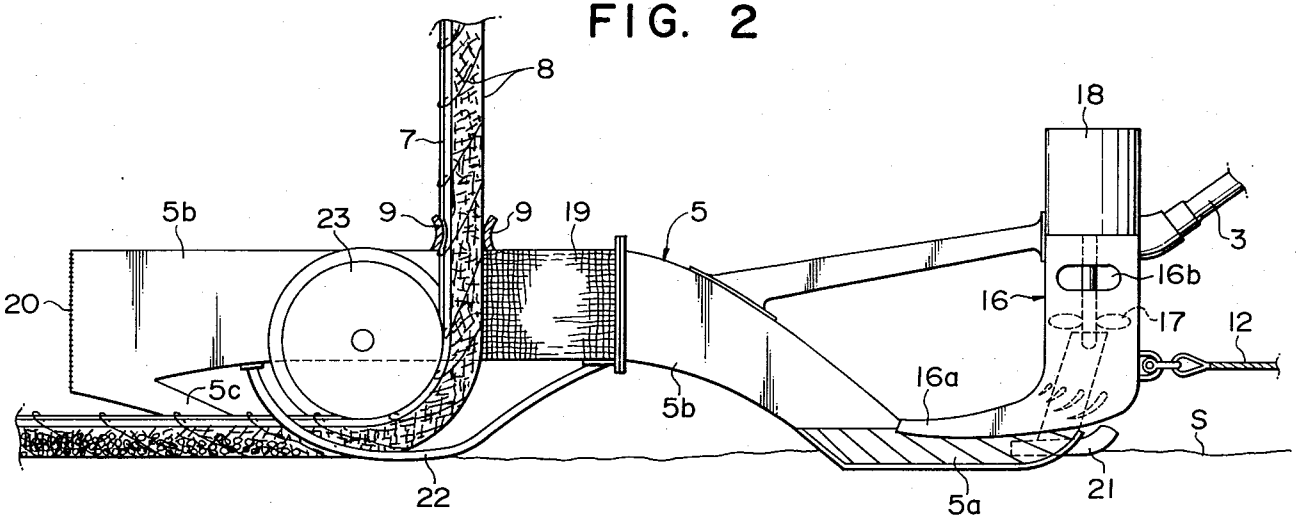
FIG. 2 is a side elevation of a sea-bottom ore collecting and filling mechanism in said apparatus.
Figure 3:
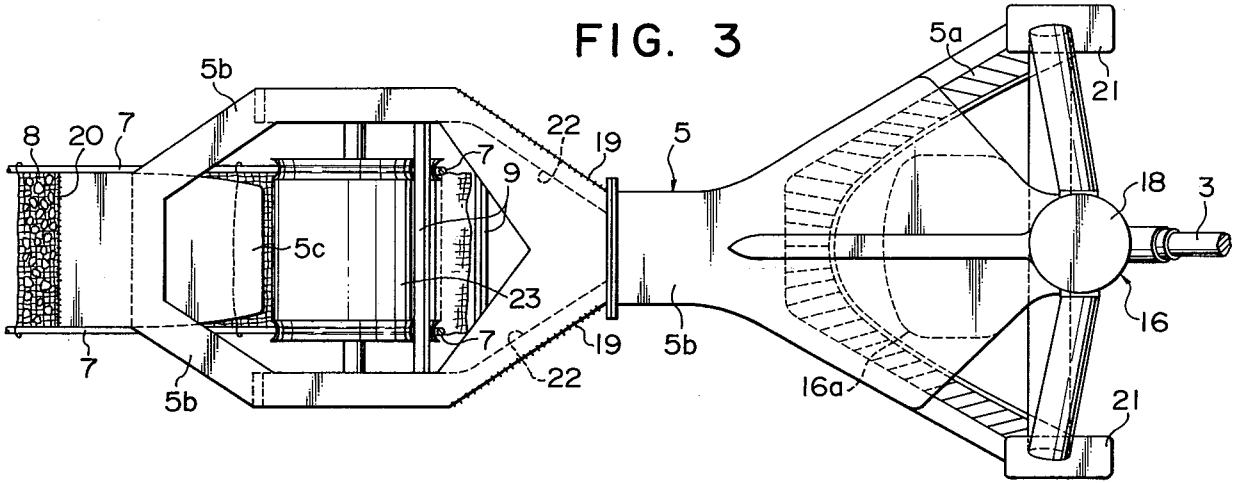
FIG. 3 is a plan view of the same.

As illustrated in FIGs. 2 and 3, the ore collecting and filling mechanism 5 consists of a V-shaped plough member 5*a*, a sea-water pump 16, having an injection nozzle 16*a* for forcibly sending ores collected by said plough member 5*a*, and a duct 5*b* for continuously casting the ores sent by said sea-water pump into the baggy nets 8.

The sea-water pump 16 has an impeller 17 for driving sea water taken in from a sea-water intake 16*b* and an impeller driving motor 18. The duct 5*b* has earth and sand discharging nets 19 and 20 on its wall portions.

The ore collecting and filling mechanism 5 is fitted also with a front sleigh 21 and a rear sleigh 22, which permits said mechanism to slide along the sea bottom S.

The front sleigh 21 has a function to prevent the plough member 5*a* from dipping too far into the sea bottom S when it is trailed.

Although simplified into a single line in FIG. 1, the lines 7 are two in number as shown in FIGS. 2 and 3. The lines 7 passed through the line guide 9 are further guided by a line guide drum 23.

The lines 7 can be sent forth in the direction of the arrow in FIG. 1, through a wire 24, by holding it with the line holding member 11*a* and operating the line driving winch 11*b*.

By repeating such operations, the lines 7 are sent forth to a desired length. With the circulation of the lines 7, the buoyant ore-collection vessel 6 also is moved by the action of a propeller that is not shown. All this permits the lines 7 to advance along the sea bottom S like an endless track.

Therefore, the baggy nets 8 attached to the lines 7 one by one reach the sea bottom S through the line guide 9. As the baggy nets 8 thus move, the line guide 9 advances along the sea bottom S, together with the ore collecting and filling mechanism 5.

With this forward movement, ores at the sea bottom are collected by the plough member 5*a*, as shown in FIGS. 2 and 3, and sent by the sea-water pump 16 into the baggy nets 8, which have arrived thereat one by one, through the duct 5*b* and an ore dropping nozzle 5*c* at the front end thereof.

Power supply to the motor 18 of the sea-water pump 16 is effected from the power and towing vessel 1 through the power line 3.

The baggy nets 8 filled with ore are pulled up as the lines 7 move ahead like an endless track, as illustrated in FIG. 1. When such baggy nets 8 reach the deck at one end of the buoyant ore-collecting vessel 6, they are turned by a roller 10*a* and the ores contained therein are dumped into a hold 6*a* of the buoyant ore-collecting vessel 6. To permit smooth execution of this ore dumping, it is desirable to blow sea water on the baggy nets 8 from a nozzle 26, using an ore dropping pump 25.

The emptied baggy nets 8, still fitted to the lines 7, are passed from the other end of the buoyant ore-collecting vessel 6 to a line holding ship 27, and then sunk to the sea bottom S through a roller 27*a* attached thereto.

When the ore collecting and filling mechanism 5 is drawn by and approaches the winch 4 at the sea bottom, the winch 4 is pulled forward by a winch 1*a* on the power and towing vessel 1, through the winch holding rope 2.

At this time, the projection 13 on the metal arm 14 is withdrawn from the sea bottom S by the oblique, upward pull of the winch holding rope 2. Then, the winch can smoothly advance along the sea bottom S, by means of the sleigh 15. As the winch 4 moves ahead, the wire 12 is paid out, thus allowing the winch 4 to be separated from the ore collecting and filling mechanism 5.

The ore collecting and filling mechanism 5 also may be trailed directly by the power and towing vessel 1, without employing the winch 4 therebetween.

As fully described above, the deep-sea ore collecting and hoisting apparatus according to this invention makes it possible to collect and hoist granular or massive ores scattered at the bottom of the deep sea, in large quantities and at high efficiency. This apparatus not only functions accurately, but also insures safe operation.

What we claim is:

1. In combination:

an apparatus for transporting ores from the bottom of a body of water to a level above the bottom of the body of water, said apparatus comprising a buoyant ore-collecting vessel for collecting ore transported from the bottom of the body of water, a flexible endless rope-like member disposable in use within the body of water with a portion thereof disposed along the bottom of the body of water and with portions extending upwardly from the bottom of the body of water to the level to which the ore is to be transported and with a portion thereof extending along the length of said buoyant ore-collecting vessel and passing over said buoyant ore collecting vessel, a plurality of baggy nets along the length of said flexible endless member for receiving ore therein and carrying the ore to the level to which the ore is to be transported as said flexible endless member is longitudinally advanced, drive means mounted on said ore-collecting vessel and cooperative with said flexible endless member for advancing said flexible endless member in a longitudinal direction thereof to transport ore contained within said baggy nets from the bottom of the body of water up to said buoyant ore-collecting vessel positioned within the body of water; and means for removing ore from within baggy nets transported up to said buoyant ore-collecting vessel and depositing the removed ore within said ore-collecting vessel; and an ore collecting and filling apparatus disposable in use on the bottom of the body of water for retrieving ore therefrom and for filling with ore said baggy nets along flexible endless member at the bottom of the body of water, said ore-collecting and filling apparatus comprising ore-retrieving means for retrieving ore from the bottom of the body of water and for filling said baggy nets with the retrieved ore, and guide means coactive with said flexible endless member for guiding said flexible endless member into position as it is advanced so that said ore-retrieving means can fill said baggy nets along said flexible endless member; wherein said apparatus for transporting ores from the bottom of a body of water further comprises: a second buoyant vessel having means for guiding said flexible endless member toward the bottom of the body of water, said second buoyant vessel being positioned in use ahead of said buoyant ore-collecting vessel with the portion of said flexible endless member extending along the length of said buoyant ore-collecting vessel further extending to said means for guiding of said second buoyant vessel and thereafter extending to said ore-collecting and filling apparatus, whereby the separation between the upwardly extending portions of said endless flexible member is substantially determined by a distance between said buoyant ore-collecting vessel and said second buoyant vessel; a winch disposable in use on the bottom of the body of water on which said ore collecting and filling apparatus is disposed, said winch having a cable connected in use to said ore-collecting and filling apparatus and being operable to let out and recover the cable; and a power and towing vessel for alternatively towing said winch along the bottom of the body of water while letting out the winch cable to position said winch on the bottom of the body of water away from said ore-collecting and filling apparatus, and thereafter powering the winch to recover the winch cable to progressively pull said ore-collecting and filling apparatus along the bottom of the body of water toward said winch to collect ore from the bottom of the body of water as it is pulled along.

* * * * *